United States Patent [19]

Attardo

[11] Patent Number: 4,923,261

[45] Date of Patent: May 8, 1990

[54] SLIDING DRAWER FOR STORING AND DISPLAYING CARDS

[76] Inventor: Kristen L. Attardo, 389 Winslow Ave., Long Beach, Calif. 90814

[21] Appl. No.: 368,285

[22] Filed: Jun. 19, 1989

[51] Int. Cl.[5] ..... A47B 88/00

[52] U.S. Cl. ..... 312/303; 312/315

[58] Field of Search ..... 312/313, 314, 315, 316, 312/309, 233, 302, 303

[56] References Cited

U.S. PATENT DOCUMENTS

| | | | |
|---|---|---|---|
| 660,797 | 10/1900 | Huelster | 312/315 |
| 1,015,722 | 1/1912 | Bezold | 312/303 |
| 1,117,338 | 11/1914 | Cox | 312/303 |
| 1,712,238 | 5/1929 | Welk | 312/315 |
| 1,776,404 | 9/1930 | Wetzel | 312/303 |
| 2,584,173 | 2/1952 | Van Fowler | 312/303 |

*Primary Examiner*—Kenneth J. Dorner
*Assistant Examiner*—Gerald A. Anderson
*Attorney, Agent, or Firm*—Scherlacher, Mok & Roth

[57] ABSTRACT

A drawer for storing and displaying cards is described. The drawer is slideably mounted beneath a supporting shelf for easy access. A drawer door is provided which is capable of limited translation and rotation with respect to the drawer. In the fully opened position, the door provides a pedestal for very convenient display and reading of the card.

7 Claims, 3 Drawing Sheets

SLIDING DRAWER FOR STORING AND DISPLAYING CARDS

BACKGROUND OF THE INVENTION

This invention relates to card storage drawers and more particularly to a drawer having a front door that is hinged to the drawer for limited rotation and translation relative thereto. Moreover, the cards which may be in the form of recipe cards and the like, are placeable on the fully opened front door for display and reading. The unique positioning of the door provides for placement of the cards on the inside of the door for ease in reading without the need for clips or fastening devices.

Card drawers are old in the art. U.S. Pat. No. 4,105,270 to Bergkamp et al., for example, describes a pull out recipe card drawer having a groove on the front facing surface of the card drawer for holding a recipe card. The drawer does not have a pivoting front door and reading the card for drawer installations on low shelves is very inconvenient.

Another example of a card drawer is described in U.S. Pat. No. 4,632,472 to Bross. The drawer is slideable from a retracted to an extended position from beneath a shelf. However, there are no provisions for mounting a card to be displayed and read on a door that is both translatable and rotatable with respect to the drawer. Thus, the novel convenience aspect of utilizing the drawer door to close off the drawer and for providing a pedestal for conveniently displaying a card to be read is not shown in the prior art.

SUMMARY OF THE INVENTION

In accordance with the present invention, a sliding drawer mounted beneath a stationary shelf for storing and displaying cards is described. The drawer has an essentially U-shaped drawer with a length defined between the front and back of the drawer. Flanges extend horizontally from the uppermost perimeter of the drawer sides to engage L-shaped brackets depending from a shelf to which the drawer is to be attached. Engagement of the flanges with the L-shaped brackets provides means for sliding the drawer from a retracted to an extended position with respect to the shelf.

A front door is mounted to the drawer by means of a U-shaped bracket. A shaft passes through the open ends of the U-shaped bracket and is coupled to an arm which extends obliquely from the inside surface of the door. By virtue of the unique hinge arrangement, the door is thus movable both in translation and rotation with respect to the drawer. In the open position the door provides a pedestal for placement of a card in a very convenient inclination for display and reading.

Preferably, the arm includes flat land surfaces which completely contact the bottom inner surface of the drawer when the door is in the open position for defining the inclination of the door in such position.

DETAILED DESCRIPTION OF THE INVENTION

Figure 1:
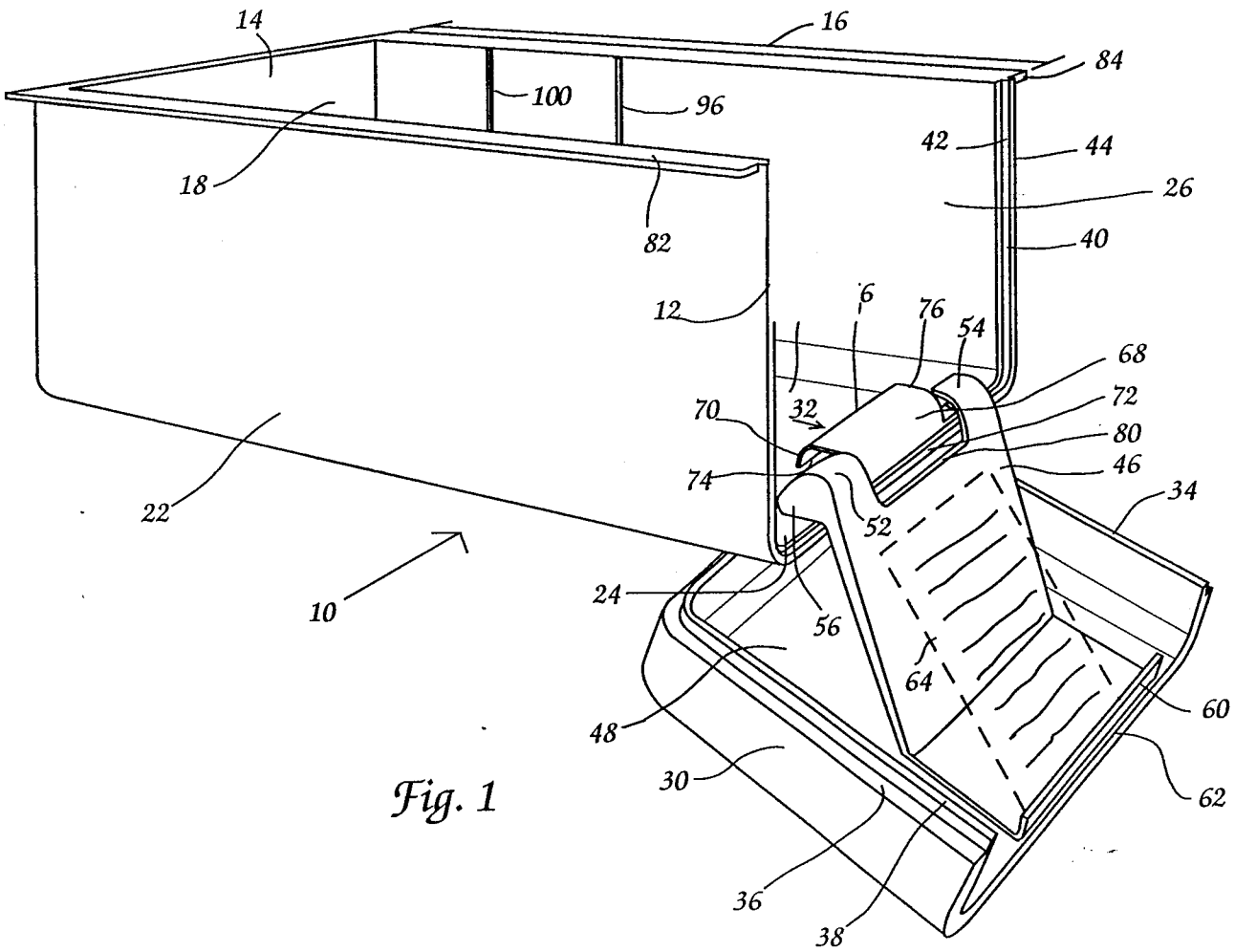
FIG. 1 is a perspective view of the sliding drawer of the present invention.

Referring now to FIG. 1, there is shown the sliding drawer of the present invention. The drawer 10 is substantially U-shaped having a front portion 12 and a back portion 14 spaced apart to thereby define a drawer length 16. The drawer 10 has an open upper portion 18 and a closed bottom portion 20. Side portion 22 extends between bottom portion edge 24 and the upper portion 18 along the drawer length 16. Similarly, side portion 26 extends between the bottom portion edge 28 and the upper portion 18 along the drawer length 16. The back portion 14 extends between the side portions 22, 26 and between the bottom portion 20 and the open upper portion 18 defining thereby the rearmost closed off extremity of the drawer 10.

A front door 30 is coupled to the drawer by means of hinge 32 and opens outwardly away from the drawer for providing a location to mount cards for display and reading. The door 30 has a U-shaped inner perimeter 34 conforming in profile to the extremities 36 of the drawer front 12.

The door perimeter 34 includes a flat step 36 which extends along the inner perimeter of the door 30. A ledge 38 extends normally from the step 36 along the innermost portion of the perimeter 34. Thus the step 36 and ledge 38 form a drawer engaging surface area being L-shaped in cross-section. The drawer front portion 12 has a corresponding L-shaped edge 40 comprising a step 42 and a ledge 44 which extends normally from the step 42. As shown best in FIG. 5, when the door 30 is in the closed position the inner perimeter 34 is in close mating relationship with the edge 40.

The door 30 also includes an essentially flat planar arm 46 which extends obliquely away from the inside surface 48 of the door 30. The angle 50 between the arm 46 and the surface 48 is preferably about 45°. The distal end of the arm 46 includes spaced apart tips 52 and 54. The tips 52 and 54 have a flat land surface 56 and 58 respectively. The surfaces 56 and 58 extend away from and are in a plane substantially normal to the plane of the arm 46. As will be further discussed in detail later, when the door is in the fully opened position, the surfaces 56 and 58 are in full contact with the bottom portion 20 of the drawer 10.

A ledge 60 extends normally from the upper portion 62 of the door 30. The ledge 60 provides a stop for a card 64, which is shown in phantom in FIG. 1, held against the stop and the arm 46 when the card is displayed for reading.

Figure 3:
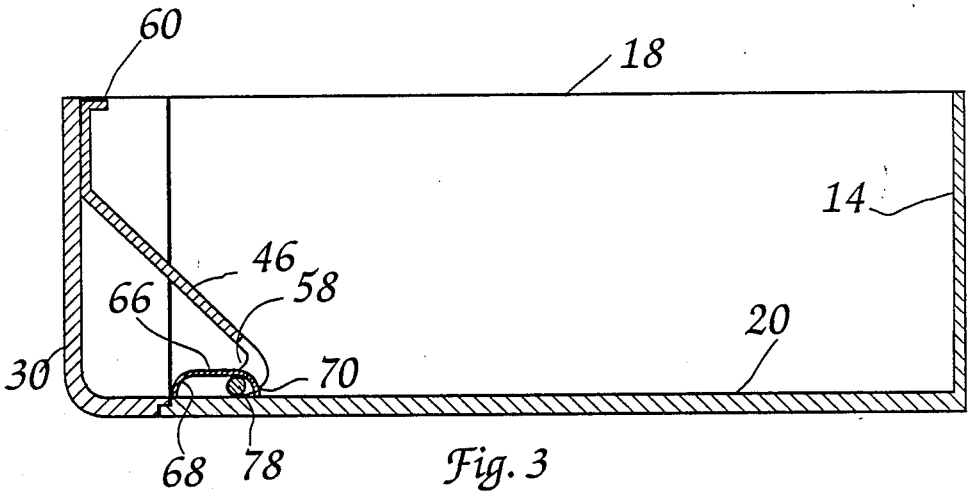
FIG. 3 is a partial cut away side elevation view of the drawer of FIG. 1 with the front door in the fully closed position.
Figure 2:
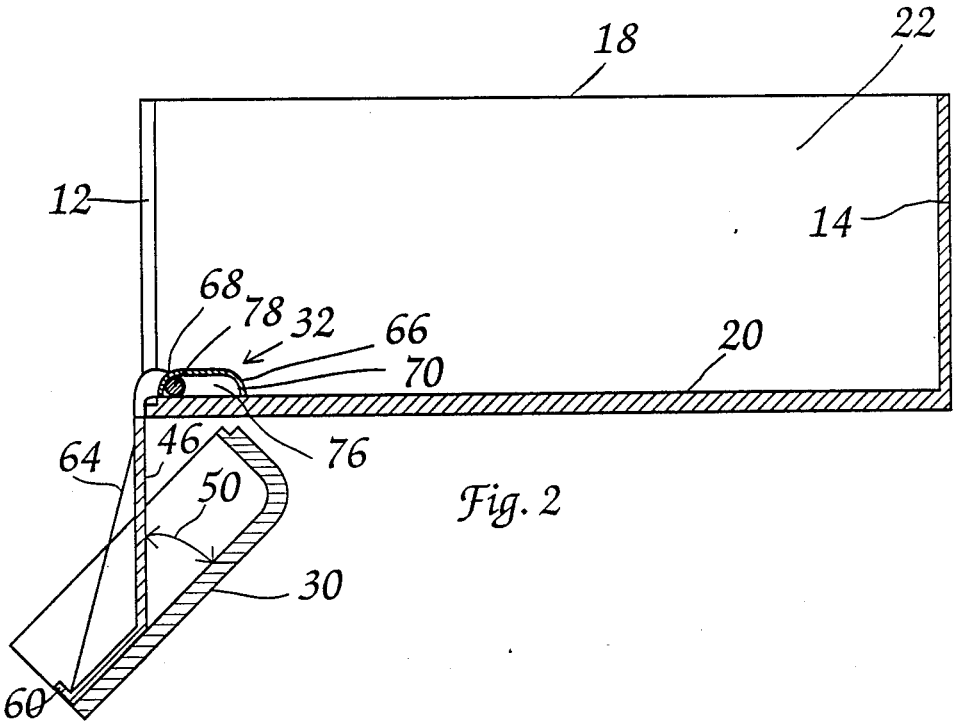
FIG. 2 is a partial cut away side elevation view of the drawer of FIG. 1 with the front door in the fully opened position.

Hinge 32 is formed of a U-shaped bracket 66 secured to the bottom portion 20 of the drawer 10. The bracket 66 has a first closed end 68 which lies along and is parallel to the frontmost perimeter 72 of the bottom portion 20. A second closed end 70 is spaced apart, from the first closed end 68, rearwardly towards the back portion 14 of the drawer 10. The bracket 66 forms an enclosed area having open ends 74 and 76. A straight shaft 78 extends through the enclosed area and the open ends 74 and 76. The shaft 78 is coupled to the tips 54 and 56 such that the door is pivotable from a closed position, as shown in FIG. 3, to a fully opened position, as shown in FIG. 2, about axes extending through the open ends of the bracket 66. A notch 80 is formed in the distal end of the arm 46 so that the door may be moved between the open and closed positions, free of interference of the bracket 66 with the arm 46.

In the opened position, as best viewed in FIG. 2, the shaft 78 is in abutment with the closed end 68 limiting thereby the movement of the door 30 away from the drawer 10. Moreover, the flat land surfaces 56 and 58 are in complete contact with the bottom portion 20 so that the arm 46 extends essentially downwardly vertically and a card to be placed against the ledge 60 is in a proper inclination for convenient reading.

In the closed position, as best shown in FIG. 3, when the inner perimeter 34 of the door 30 is fully engaged with the drawer edge 40, the shaft 78 is repositioned to a station adjacent the closed end 70. Accordingly, before movement of the door 30 between a fully opened and fully closed position, the hinge 32 provides for limited translation between the closed ends of the bracket 66 during rotation of the shaft about axes extending through the open ends 74 and 76.

Figure 4:
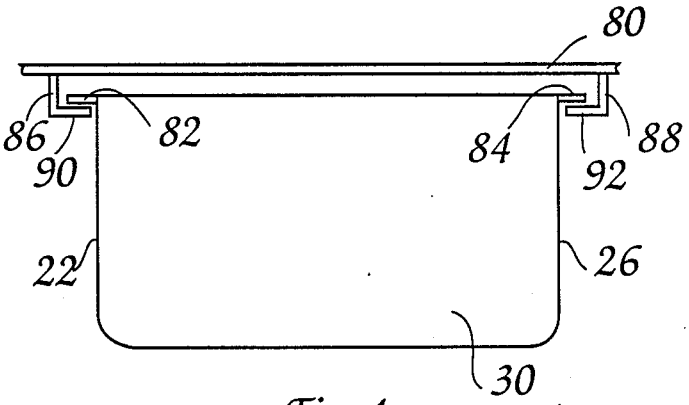
FIG. 4 is a front elevation view of the drawer of FIG. 1 mounted underside of a supporting shelf.

Referring now to FIG. 4, there is shown a drawer 10 mounted to the underside of shelf 80. More specifically, a pair of flanges 82, 84 extend normally outwardly from the upper extremities of side portions 22 and 24 respectively.

Depending from shelf 80 are a pair of L-shaped brackets 86, 88 which are adapted to engage the flanges 82, 84 respectively. Accordingly, the inwardly facing extension 90 supports flange 82 while inwardly facing extension 92 supports flange 84 in such a manner that the drawer 10 is slideable on brackets 86, 88 from a retracted position to an extended position relative to the shelf 80.

Figure 5:
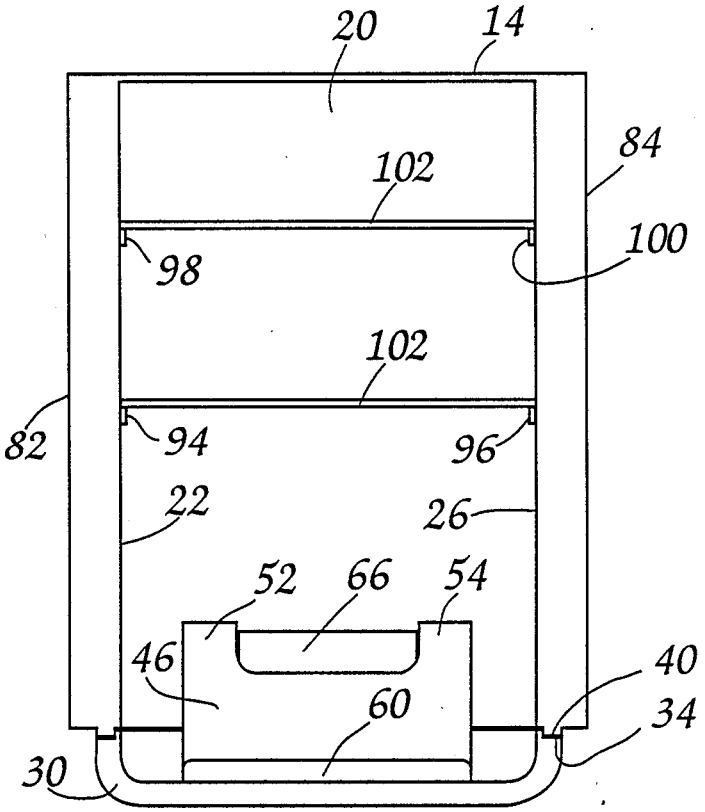
FIG. 5 is a top view of the drawer of FIG. 1 with the door in the closed position.

As shown in FIG. 5, a pair of projections 94 and 96 extend vertically on side portions 22 and 26 respectively. Similarly, projections 98 and 100 extend vertically on side portions 22 and 26 respectively. An essentially flat plate 102, conforming to the U-shaped inner contour of the drawer, may be placed in abutment with corresponding projections to compartmentalize the interior of the drawer for storing selected cards in respective compartments. The flat plates 102 are easily insertable and removable depending upon the number of cards to be stored in the drawer 10.

What is claimed is:

1. A sliding drawer mounted beneath a stationary shelf for storing and displaying cards comprising:

an elongated U-shaped drawer having a length from front to back thereof, the drawer having an open upper end, a closed bottom portion and side portions extending from the closed bottom portion to the upper end along the drawer length, a front door, card holding means located on the inside surface of the door for holding cards to be displayed; and an arm extending obliquely from the inside surface of the door, including spaced apart first and second tips located at the distal end of the arm, each tip having a flat land surface for contacting the inside surface of the bottom portion of the drawer when the door is in the fully opened position, and hinge means for coupling the door to the drawer comprising a U-shaped bracket having first and second closed ends secured to the bottom portion of the drawer defining thereby an open ended shroud, a shaft extending through the open ends of the shroud and coupled to the arm between the first and second tips thereof, such that the door is translatable between the closed ends of the bracket and rotatable about the axis of the shaft which extends through the open ends of the shroud such that while the door is in the fully opened position the flat land surfaces contact the bottom portion to define an inclination of the opened door with respect to the drawer.

2. The sliding drawer of claim 1, further comprising flange means extending outwardly from the upper extremities of the side portions.

3. The sliding drawer of claim 2, further comprising L-shaped guide rails depending from the underside of the shelf and adapted to engage the flange means in a tongue and groove type arrangement.

4. The sliding drawer of claim 3, wherein the first closed end of the U-shaped bracket extends along and adjacent to the front extremity of the bottom of the drawer and the second closed end is spaced apart from the first closed end in a direction towards the rear of the drawer.

5. The sliding drawer of claim 4, such that when the drawer is in the fully opened position, the shaft is in abutment with the first closed end of the U-shaped bracket, thereby limiting the movement of the door away from the drawer.

6. The sliding drawer of claim 5, wherein the extremities of the front of the drawer lie in a first plane, and when the drawer is in the fully opened position the arm lies in a vertical plane substantially parallel to the first plane.

7. The sliding drawer of claim 1, wherein the card holding means comprising a ledge extending normally from the upper inside surface of the door, the ledge forming a stop wherein a card is held against the stop and the arm for display when the door is in the fully opened position.

* * * * *